US006575589B2

(12) United States Patent
Hisasue et al.

(10) Patent No.: US 6,575,589 B2
(45) Date of Patent: Jun. 10, 2003

(54) PEN HOLDER FOR INTERACTIVE BOARD

(75) Inventors: Koji Hisasue, Fukuoka (JP); Motoharu Kouda, Onojo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 15 days.

(21) Appl. No.: 09/864,231

(22) Filed: May 25, 2001

(65) Prior Publication Data

US 2002/0051359 A1 May 2, 2002

(30) Foreign Application Priority Data

May 31, 2000 (JP) ..... 2000-162032

(51) Int. Cl.[7] ..... B43K 29/10
(52) U.S. Cl. ..... 362/118; 345/179
(58) Field of Search ..... 345/179, 180, 345/181, 182, 183, 173; 178/18.01, 19.01; 362/118

(56) References Cited

U.S. PATENT DOCUMENTS 5,422,442 A * 6/1995 Gouda et al. ..... 178/18
5,434,373 A * 7/1995 Komaki ..... 178/87
5,747,748 A * 5/1998 Zigler ..... 178/18
5,864,098 A * 1/1999 Shinohe ..... 178/19.01
6,031,936 A * 2/2000 Nakamura ..... 382/187
6,104,388 A * 8/2000 Nagai et al. ..... 345/179
6,441,362 B1 * 8/2002 Ogawa ..... 250/221

FOREIGN PATENT DOCUMENTS

JP 2000 355188 12/2000

* cited by examiner

*Primary Examiner*—Sandra O'Shea
*Assistant Examiner*—Sharon Payne
(74) *Attorney, Agent, or Firm*—Stevens, Davis, Miller & Mosher, LLP

(57) ABSTRACT

In a pen holder comprising an emitter for emitting at least one of light beam and supersonic waves to be detected by a sensor so that a signal corresponding to a position of the pen holder is generated by the sensor on the basis of the detected at least one of light beam and supersonic waves, a pen holder including an opening which is arranged at a longitudinal end of the pen holder in such a manner that a front portion of the pen including an end at which end the visible line is drawn on the board projects from the opening out of the pen holder, and through which a part of the pen other than the front portion of the pen is mountable from an outside of the pen holder onto the pen holder so that the pen is held on the pen holder.

10 Claims, 2 Drawing Sheets

PEN HOLDER FOR INTERACTIVE BOARD

BACKGROUND OF THE INVENTION AND RELATED ART STATEMENT

The present invention relates to a pen holder for holding thereon a pen for drawing a visible line on a board while a sensor generates a signal corresponding to a position of the pen holder on the board.

In an interactive board system as disclosed by JP-A-2000-355188, a position of a pen holder holding therein a pen for drawing a visible line on a board is detected by a sensor arranged on the board to receive a light beam or supersonic waves emitted from the pen holder so that a signal corresponding to the detected position of the pen holder is generated by the sensor to be input to a computer.

OBJECT AND SUMMARY OF THE INVENTION

An object of the present invention is to provide a pen holder for holding thereon a pen for drawing a visible line on a board while a sensor generates a signal corresponding to a position of the pen holder on the board, a radial size of which pen holder can be minimized while holding stably the pen in the pen holder.

A pen holder for holding thereon a pen for drawing a visible line on a board while a sensor generates a signal corresponding to a position of the pen holder on the board, comprises, an emitter for emitting at least one of light beam and supersonic waves to be detected by the sensor so that the signal is determined from the detected at least one of light beam and supersonic waves, and a holder body including an opening which is arranged at a longitudinal end of the pen holder in such a manner that a front portion of the pen including an end at which end the visible line is drawn on the board projects from the opening out of the pen holder, and through which a part of the pen other than the front portion of the pen is mountable from an outside of the pen holder onto the pen holder so that the pen is held on the pen holder.

Since the part of the pen other than the front portion of the pen is mountable from the outside of the pen holder onto the pen holder through the opening at the longitudinal end of the pen holder, a radial size of the pen holder can be minimized while holding stably the pen in the pen holder.

The pen holder may further comprise a locking member for holding thereon the part of the pen stationarily, the locking member is movable on the holder body between first and second positions, the at least one of light beam and supersonic waves is permitted to be emitted by the emitter when the locking member is positioned at the first position, and the at least one of light beam and supersonic waves is prevented from being emitted by the emitter when the locking member is positioned at the second position.

If the pen has a cap removably mounted on the pen to cover at least the front portion of the pen, and the opening has an inner diameter sufficient for receiving therein a part of the cap so that the part of the cap extends through the opening into the pen holder, the pen holder with the pen covered by the cap can emit effectively the light beam (infrared rays) and/or supersonic waves to be detected by the sensor for generating the signal corresponding to the position of the pen holder on the board on the basis of the detected light beam (infrared rays) and/or supersonic waves.

If the opening has an inner diameter not less than a maximum diameter of the pen, the whole of the pen can be received in the pen holder through the opening. It is preferable that the opening has an inner diameter sufficient for mounting the part of the pen from the outside of the pen holder onto the pen holder through the opening and removing the part of the pen from the pen holder to the outside of the pen holder through the opening.

It is preferable for stably holding the pen in the pen holder that a spring urges the locking member toward the opening so that the pen is urged toward the opening through the locking member.

It is preferable for minimizing the radial size of the pen holder that the locking member has clamping portions whose distance in a direction perpendicular to a longitudinal direction of the pen and the pen holder is elastically changeable so that the part of the pen is held stationarily between the clamping portions with a frictional force between the part of the pen and the clamping portions generated by an elastic clamping force between the clamping portions in the direction perpendicular to the longitudinal direction of the pen.

It is preferable for preventing an excessive axial or longitudinal force from being applied to the pen that the holder body includes a stop portion extending perpendicularly to a movable direction of the locking member on the holder body to engage with the movable locking member so that a movement of the locking member toward the opening is limited by the stop portion when the part of the pen is held on the locking member, so that the holder body is prevented from being pressed against the pen in the movable direction of the locking member to limit through the pen the movement of the locking member toward the opening.

The locking member is positioned at the first position when the pen holder is urged toward the board so that the end of the pen is pressed against the board, and the locking member is positioned at the second position when the pen holder is prevented from being urged toward the board so that the end of the pen is separated away from the board.

If the locking member extends circumferentially so that, as seen in a longitudinal direction of the pen and the pen holder, the pen is substantially surrounded by the locking member to restrain a movement of the pen with respect to the locking member in each of radial directions perpendicular to each other, the pen is stably held in the locking member.

DETAILED DESCRIPTION OF PREFERRED EMBODIMENTS

Figure 1:
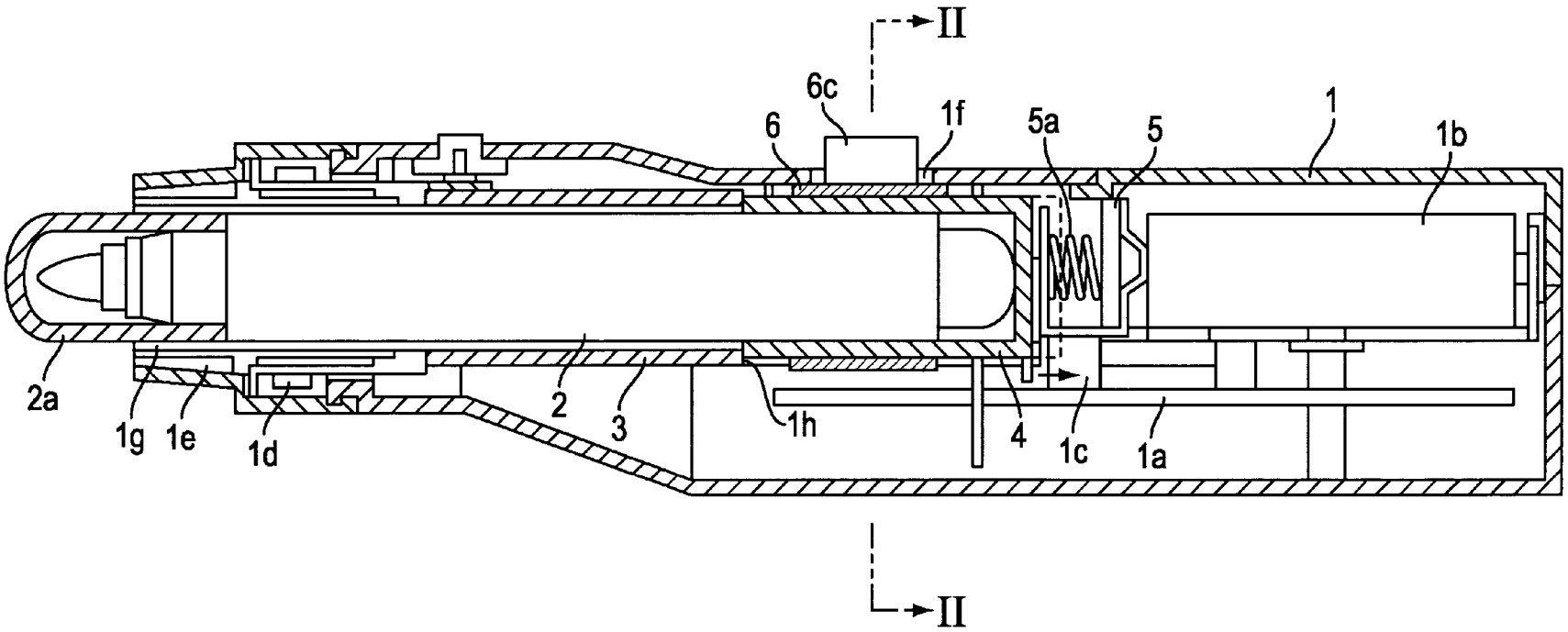
FIG. 1 is a longitudinal cross-sectional view showing a pen holder of the invention.

A pen 2 including a detachable cap 2*a* for covering detachably a front end of the pen 2 at which end a visible line is drawn on a board (not shown) is mounted in a pen holder 1. A battery 1*b*, a switch 1*c* for detecting a position of the pen 2 to allow light beam (infrared rays) and/or supersonic waves to be emitted from the pen holder 2 when the front end of the pen 2 is pressed against the board by an operator holding the pen holder 1, an infrared rays emitter 1*d*, a supersonic waves emitter 1*e*, and an electric control circuit 1*a* for driving the infrared rays emitter 1*d* and the supersonic waves emitter 1*e* in response to the detected position of the pen 2 are mounted on the pen holder 1.

The pen holder 1 has an opening 1*g* at a front end thereof, and the pen 2 is inserted into the pen holder 1 through the opening 1*g*. The pen 2 mounted onto the pen holder 1 through the opening 1*g* is supported longitudinally movably in a stationary sleeve 3 and received by a movable sleeve 4 (as the claimed locking member) contacting a rear end of the pen 2 and surrounding circumferentially a rear part of the pen 2. A spring 5*a* is arranged between a stationary stopper 5 of the pen holder 1 and the movable sleeve 4 to urge elastically the movable sleeve 4 toward the opening 1*g*, while a movement of the movable sleeve 4 with the pen 2 toward the opening 1*g* is limited by a stop portion 1*h* of the pen holder 1.

Figure 2A:
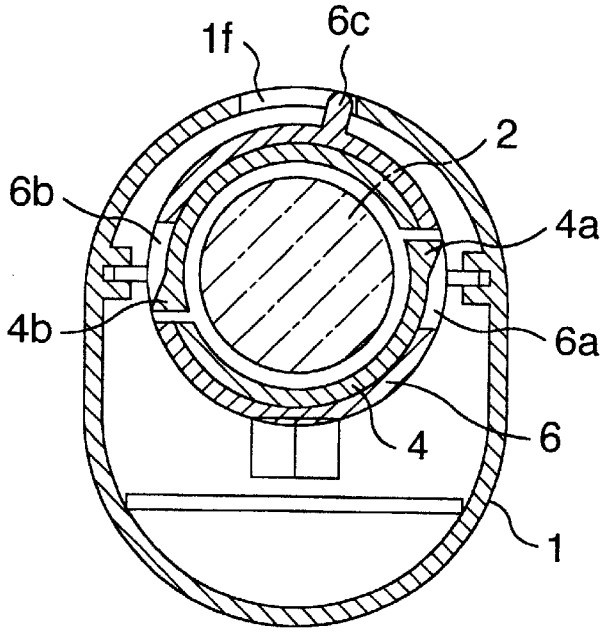
FIG. 2*a* is a cross cross-sectional view taken along II-II in FIG. 1 to show the pen holder in a pen releasing condition.

As shown in FIG. 2*a*, in a condition in which the pen 2 is released from the pen holder 1 to be inserted to a bottom of the movable sleeve 4 in the pen holder 1 through the opening 1*g* and the stationary sleeve 3 and to be taken out of the pen holder 1 through the opening 1*g* and the stationary sleeve 3, the movable sleeve 4 is surrounded by a locking ring 6 which is movably guided in a pair of grooves 1*x* and 1*y* of the pen holder 1 longitudinally or axially and is rotatable around the movable sleeve 4, while radially expanded portions 4*a* and 4*b* (as the claimed clamping portions) of the movable sleeve 4 terminating circumferentially are received respectively in grooves 6*a* and 6*b* of the locking ring 6 so that the radially expanded portions 4*a* and 4*b* are prevented from being pressed radially inward against the pen 2 by the locking ring 6 to fix the movable sleeve 4 to the pen 2.

Figure 2B:
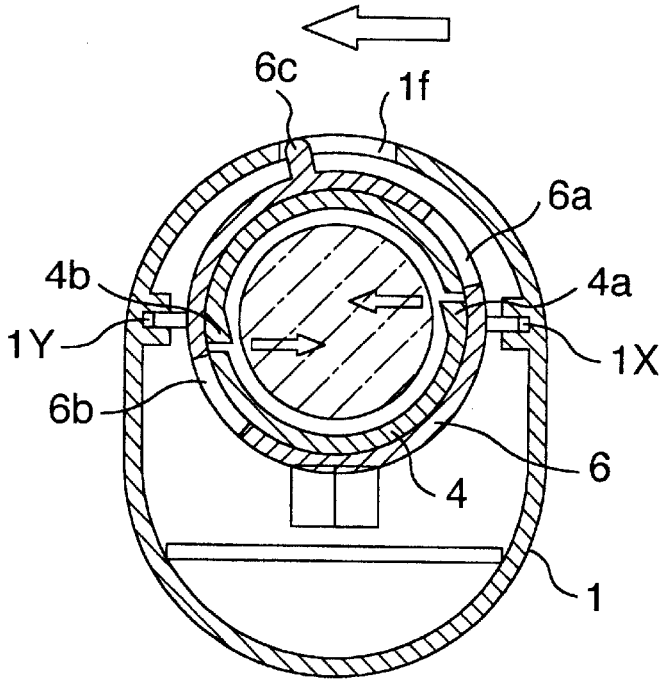
FIG. 2*b* is a cross cross-sectional view taken along II-II in FIG. 1 to show the pen holder in a pen stationarily holding condition.

As shown in FIG. 2*b*, by rotating a lever 6*c* of the locking ring 6 in a slot 1*f* of the pen holder 1 for allowing the rotation of the lever 6*c* and the longitudinally or axially movement of the movable sleeve 4 between a first position (defined by the stop portion 1*h* and a second position defined by the dashed lines in FIG. 1) at which the movable sleeve 4 is detected by the switch 1*c* to allow the light beam (infrared rays) and/or supersonic waves to be emitted from the pen holder 2 when the front end of the pen 2 is pressed against the board by an operator holding the pen holder 1 with a longitudinal or axial force more than a predetermined degree to move the movable sleeve 4 to the second position, the radially expanded portions 4*a* and 4*b* are separated away circumferentially from the circumferentially extending grooves 6*a* and 6*b* so that the expanded portions 4*a* and 4*b* are pressed radially inward against the pen 2 by the locking ring 6 to fix the movable sleeve to 4 the pen 2.

A removable cap 2*a* extends through the opening 1*g* into the pen holder 1 along the pen 2 and/or is prevented from covering the infrared rays emitter 1*d* and the supersonic waves emitter 1*e* when the cap 2*a* covers the front end of the pen 2 to prevent the visible line from being drawn thereat, so that the pen holder 1 with the pen 2 covered by the cap 2*a* can emit effectively the light beam (infrared rays) and/or supersonic waves to be detected by a sensor (not show) for generating a signal corresponding to a position of the pen holder on the board on the basis of the detected light beam (infrared rays) and/or supersonic waves.

What is claimed is:

1. A pen holder for holding thereon a pen for drawing a visible line on a board while a sensor generates a signal corresponding to a position of the pen holder on the board, comprising, an emitter for emitting at least one of light beam and supersonic waves to be received by the sensor so that the signal is determined from the received at least one of light beam and supersonic waves;

a holder body including an opening which is arranged at a longitudinal end of the pen holder in such a manner that a front portion of the pen including an end at which end the visible line is drawn on the board projects from the opening out of the pen holder, and through which a part of the pen other than the front portion of the pen is mountable from an outside of the pen holder onto the pen holder so that the pen is held on the pen holder; and a locking member for holding the part of the pen stationarily thereon, the locking member being movable on the holder body between first and second positions, the at least one of the light beam and the supersonic waves is permitted to be emitted by the emitter when the locking member is positioned at the first position, and the at least one of the light beam and the supersonic waves is prevented from being emitted by the emitter when the locking member is positioned at the second position.

2. A pen holder according to claim 1, wherein the pen has a cap removably mounted on the pen to cover at least the front portion of the pen, and the opening has an inner diameter sufficient for receiving therein a part of the cap so that the part of the cap extends through the opening into the pen holder.

3. A pen holder according to claim 1, wherein the opening has an inner diameter not less than a maximum outer diameter of the pen.

4. A pen holder according to claim 1, wherein the opening has an inner diameter sufficient for mounting the part of the pen from the outside of the pen holder onto the pen holder through the opening and removing the part of the pen from the pen holder to the outside of the pen holder through the opening.

5. A pen holder according to claim 1, further comprising a spring for urging the locking member toward the opening so that the pen is urged toward the opening through the locking member.

6. A pen holder according to claim 1, wherein the locking member has clamping portions a distance of which in a direction perpendicular to a longitudinal direction of the pen holder is elastically changeable so that the part of the pen is held stationarily between the clamping portions with a frictional force between the part of the pen and the clamping portions generated by an elastic clamping force between the clamping portions in the direction perpendicular to the longitudinal direction of the pen.

7. A pen holder according to claim 1, wherein the holder body includes a stop portion extending perpendicularly to a movable direction of the locking member on the holder body to engage with the movable locking member so that a movement of the locking member toward the opening is limited by the stop portion when the part of the pen is held on the locking member.

8. A pen holder according to claim 7, wherein the holder body is prevented from being pressed against the pen in the movable direction of the locking member to limit through the pen the movement of the locking member toward the opening.

9. A pen holder according to claim 1, wherein the locking member is positioned at the first position when the pen holder is urged toward the board so that the end of the pen is pressed against the board, and the locking member is positioned at the second position when the pen holder is prevented from being urged toward the board so that the end of the pen is separated away from the board.

10. A pen holder according to claim 1, wherein the locking member extends circumferentially so that, as seen in a longitudinal direction of the pen holder, the pen is surrounded by the locking member to restrain a movement of the pen with respect to the locking member in each of radial directions perpendicular to each other.

* * * * *